United States Patent [19]

Fink

[11] Patent Number: 4,680,877

[45] Date of Patent: Jul. 21, 1987

[54] SHOE INSOLE

[75] Inventor: Hans Fink, Möhlin, Switzerland

[73] Assignee: Bata Schuh AG, Mohlin, Switzerland

[21] Appl. No.: 748,832

[22] Filed: Jun. 26, 1985

[30] Foreign Application Priority Data

Jul. 2, 1984 [CH] Switzerland ..... 3176/84

[51] Int. Cl.[4] ..... A43B 13/38; A43B 7/06

[52] U.S. Cl. ..... 36/44; 36/3 B

[58] Field of Search ..... 36/44, 43, 3 R, 3 B, 36/33.13; 12/146 B; 128/581, 586

[56] References Cited

U.S. PATENT DOCUMENTS

| | | | |
|---|---|---|---|
| 1,411,021 | 3/1922 | Haskell | 36/44 X |
| 1,975,972 | 10/1934 | Peschke | 36/44 |
| 2,767,490 | 10/1956 | Smith, Jr. | 36/44 |
| 3,274,708 | 9/1966 | Lukas | 36/3 R |
| 4,099,342 | 7/1978 | Singh | 36/44 |
| 4,224,746 | 9/1980 | Kim | 36/3 B |

FOREIGN PATENT DOCUMENTS

| | | | |
|---|---|---|---|
| 3009247 | 9/1981 | Fed. Rep. of Germany | 36/44 |
| 485355 | 10/1917 | France | 36/33 |
| 23821 | of 1912 | United Kingdom | 36/44 |

*Primary Examiner*—James Kee Chi

*Attorney, Agent, or Firm*—Helfgott & Karas

[57] ABSTRACT

An insole structure having an outer contour corresponding to the shape of the sole of the foot has outer layers between which are located inner layers. The outer layers are made from a wear resistant material such as beechwood, and the inner layers are made from a lighter material such as poplar. The separately cut layers are glued together and shaped to form an anatomically contoured, substantially rigid structure.

5 Claims, 3 Drawing Figures

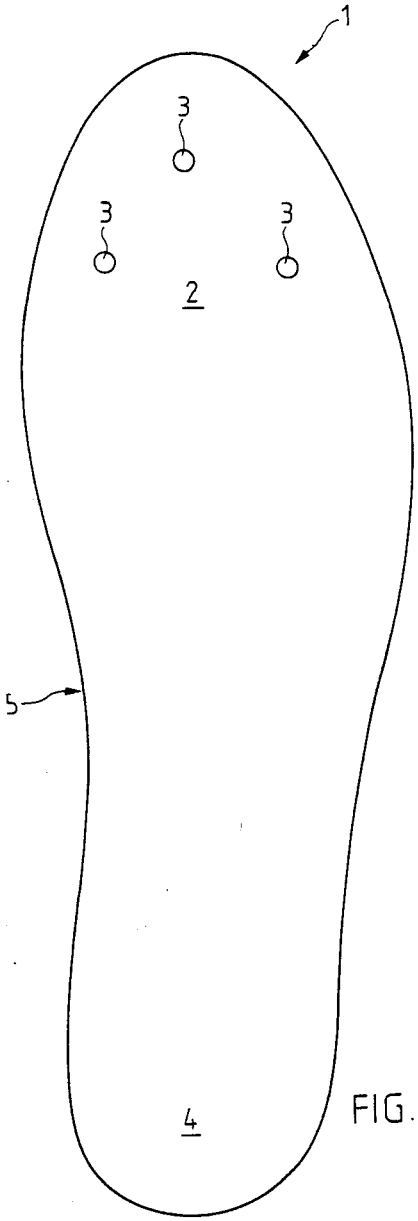
FIG. 1
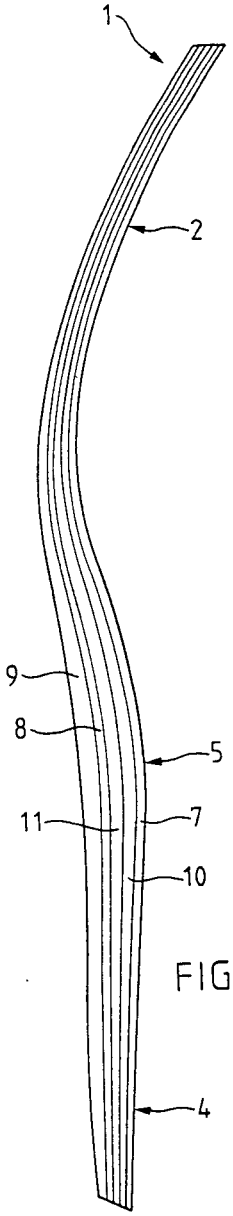
FIG. 2.
FIG. 3
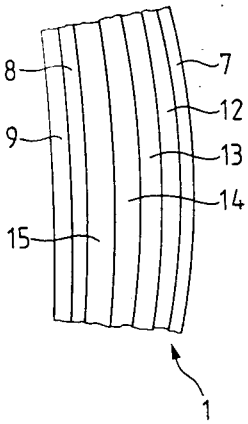

SHOE INSOLE

This invention relates to a shoe and particularly to an insole structure for use in a sports shoe.

BACKGROUND OF THE INVENTION

There are certain types of shoes in which it is necessary that the bottom of the shoe does not deform while the shoe is being worn. This is the case, for example, with shoes designed for use in certain sports such as cycle racing, hockey and also in the boots for use with roller skates.

In such cases, it would be possible to achieve the necessary rigidity by inserting a hard, stiff insert of metal or the like in the bottom of the shoe to give it the necessary stability. However, this is not easily done because a metal insert would not be able to form a continuous structure with the remaining constituents of the shoe bottom. Additionally, it is only possible to a very limited extent to thread screws into a thin metal insert incorporated into a shoe bottom for attaching the remaining apparatus necessary for the particular sport such as, for example, in a roller skate or ice skate.

SUMMARY OF THE INVENTION

Accordingly, an object of the present invention is to provide a shoe having an insole which is rigid and into which it is possible to thread screws for attaching other apparatus to the shoe sole.

Briefly described, the invention comprises a shoe insole particularly for use in a sports shoe comprising a plurality of layers including a first layer of a tough, wear-resistant material having a first specific gravity, and a second layer of material having a second specific gravity which is lower than said first specific gravity and means for firmly interconnecting said layers.

In another aspect, the invention comprises a method of producing a shoe insole of the type having a plurality of layers of material including a first layer of a tough, wear-resistant first material and a second layer of a second, lighter material comprising the steps of providing substantially flat sheets of the first and second materials, cutting from the sheets substantially flat insole-shaped portions, adhering the portions together in a substantially coextensive relationship, and shaping the resulting structure to have a generally foot-conforming curvature.

BRIEF DESCRIPTION OF THE DRAWINGS

In order to impart full understanding of the manner in which these and other objectives are attained in accordance with the invention, particularly advantageous embodiments thereof will be described with reference to the accompanying drawings, which form a part of this specification, and wherein:

FIG. 1 is a top plan view of an insole structure in accordance with the invention;

FIG. 2 is a side elevation of the insole of FIG. 1 separate from the shoe or boot in which it will be used; and FIG. 3 is an enlarged fragmentary view of a further embodiment of an insole in accordance with the invention.

DESCRIPTION OF PREFERRED EMBODIMENTS

As is known, the insole constitutes that part of the bottom of the shoe on which the wearer's foot rests. The shoe or boot leg is attached to the insole and then the outer sole is applied thereto.

An insole 1 in accordance with the invention is shown in plan view in FIG. 1 from which it will be recognized that the general shape of the insole is quite conventional. In the vicinity of the toe area 2 of the insole, adjacent the region where the toes of the foot are usually located, the insole is provided with three openings 3 which extend entirely through the insole. As will become apparent, the insole is otherwise impermeable to air and moisture and the openings 3 serve to ventilate the toe area of the shoe.

As can be seen from the side elevation of FIG. 2, the insole 1 is shaped to conform to the curvature of the sole of the human foot. Between the toe area 2 and the heel area 4, the insole is provided with a central area indicated generally at 5 which is upwardly raised or curved in a convex fashion. The curvature of the foot instep thus normally rests on central area 5 of insole 1.

In accordance with the embodiment of FIGS. 1 and 2, the insole is provided with layers 7 and 8 of a tough, wear-resistant material. Layers 7 and 8 of insole 1 can be made, for example, of beechwood. The region 9 shown adjacent and below the lower strong layer 8 of the insole represents the underside of layer 8. The fibers of the strong outer layers 7, 8 advantageously run in the longitudinal direction of the insole.

The inner edge portion of the central edge area of insole 1 has an upwardly directed bend on which the instep curvature of the foot normally rests. Between the edge portion of that area 5 of insole 1 and the opposite end portion of the central area 5 there is a downwardly directed bend on which the outer central part of the foot normally rests. These curvatures are obtained by corresponding shaping of the partly finished product used for producing the insole as will be described.

Between outer layers 7 and 8 of the insole are provided two further layers 10 and 11 which increase the rigidity of the insole. In order that these layers 10, 11 do not unnecessarily increase the weight of the insole structure, they are made, for example, from poplar wood which is lighter and is also more compressible than beechwood.

A further embodiment of an insole in accordance with the invention is shown in the fragmentary view of FIG. 3 which represents a portion of the region 5 of the insole and which includes outer layers 7 and 8 and, in addition, four inner layers 12, 13, 14 and 15 which are made from a lightweight material. Again, these four inner layers 12–15 can be made from poplar.

In the embodiment of FIG. 3, the fibers or grain of each two adjacent, directly superimposed layers 10–15 are arranged so that they are approximately perpendicular to each other so that the strength of the structure is increased. Specifically, the grain of layer 13 is perpendicular to layer 12, that of 14 is perpendicular to 13 and of 15 is perpendicular to 14.

Layers 7, 8, 10 and 11 of the embodiment of FIG. 2 or layers 7, 8 and 12–15 of the embodiment of FIG. 3 are glued together so that they form a firm and substantially undeformable structure in the environment of their normal intended use.

It will be recognized that it is possible to use materials other than those referred to above for the outer, strong layers 7, 8 and this also applies with respect to the inner layers. The material chosen for inner layers 10–15 should be one which is more compressible than that used for outer layers 7, 8. Thus, the insole 1 must, for anatomical reasons, have different thicknesses in various areas thereof. The increased flexibility of the inner layers 10–15 makes it possible to easily achieve these differences in the thicknesses of the insole.

The insole 1 is produced by first providing sheet-like pieces of the materials and separating from those sheets, by cutting or stamping, the portions which will be assembled to form the insole. The portions are cut to have the necessary shape for producing the insole as illustrated in FIG. 1 in which the normal insole contour appears.

The portions cut from the sheets of material are coated with glue, placed on one another in a substantially coextensive relationship and pressed together so that a firm structure is formed. After drying or curing of the bonding material, the resulting structure is shaped, using pressure and steam, so that the contour similar to that illustrated in FIG. 2 can be achieved. The shaped insole is thus formed from the originally flat, semi-finished product. Thus, insole 1 has a depression in the toe area 2, a curvature in the central area 5 and a generally flat region in the heel area 4. The press tools used for shaping the semifinished product are designed in such a way that they have a larger mutual spacing in the central area 5 of the insole than in the areas of toe 2 and heel 4. Thus, the inner layers 10–15 in the central area 5 are less compressed during deformation than are the remaining areas 2 and 4 of the insole. After shaping, the edges of the finished insole can be treated as by milling and grinding.

The insole described herein can be used for producing sport shoes particularly of the type known as bonded shoes. A marginal strip of the upper leather, optionally with a lining, is placed around the edge of the finished insole and bonded thereto. The marginal strip and bottom of the insole are then covered with an outer sole, which can be leather, which is bonded to the entire surface. Depending upon the intended function of the final shoe, the outer sole can wholly or partly be provided with a layer of an elastomer which can be ribbed.

While certain advantageous embodiments have been chosen to illustrate the invention, it will be understood by those skilled in the art that various changes and modifications can be made therein without departing from the scope of the invention as defined in the appended claims.

What is claimed is:

1. A Shoe insole particularly for use in a sports shoe comprising a plurality of layers including a first layer of tough, wear - resistant wood material having a first specific gravity and a second layer of wood material having a second specific gravity which is lower than said first specific gravity, said second wood material being more compressible than said first wood material, and comprising at least one layer of said second wood material between two layers of said first wood material, and means for firmly interconnecting said layers.

2. A shoe insole according to claim 1 wherein said first material is beechwood and said second wood material is poplar wood.

3. A shoe insole according to claim 2 wherein four layers of poplar wood are placed between two layers of beechwood, and wherein said layers of poplar are arranged so that the fibers in alternate layers are substantially perpendicular to each other.

4. A shoe insole according to claim 1 wherein said insole includes means defining holes extending through the toe end thereof.

5. A shoe insole according to claim 1, wherein said layers are in a shape to conform to the contour of a foot, said layers of said first wood material being of substantially uniform thickness throughout the length of the insole and the at least one layer of said second wood material being compressed thinner in selected areas and thicker in other areas to conform to said contour.

* * * * *